US007116060B2

(12) United States Patent
Lin et al.

(10) Patent No.: US 7,116,060 B2
(45) Date of Patent: Oct. 3, 2006

(54) PLASMA DISPLAY PANEL HAVING A PLURALITY OF BI-DISCHARGE SOURCES AND RELATED METHOD OF SUSTAINING DISCHARGE WAVEFORM

(75) Inventors: Chun-Hsu Lin, Taipei (TW); Po-Kun Hsieh, Taoyuan (TW); Hsu-Pin Kao, Taoyuan (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 155 days.

(21) Appl. No.: 11/007,204

(22) Filed: Dec. 9, 2004

(65) Prior Publication Data

US 2006/0125406 A1 Jun. 15, 2006

(51) Int. Cl.
*G09G 3/10* (2006.01)

(52) U.S. Cl. ..... 315/169.4; 315/169.1; 345/60; 345/67; 345/103; 313/582

(58) Field of Classification Search ..... 315/169.1, 315/169.4, 160; 345/60–62, 66–68, 103; 313/582

See application file for complete search history.

(56) References Cited

U.S. PATENT DOCUMENTS

| | | | | |
|---|---|---|---|---|
| 6,144,349 | A * | 11/2000 | Awata et al. | 345/67 |
| 6,288,693 | B1 * | 9/2001 | Song et al. | 345/68 |
| 6,538,627 | B1 * | 3/2003 | Whang et al. | 345/60 |
| 6,541,922 | B1 * | 4/2003 | Shirozu | 315/169.4 |
| 6,911,783 | B1 * | 6/2005 | Mima | 315/169.4 |

* cited by examiner

*Primary Examiner*—Haissa Philogene
(74) *Attorney, Agent, or Firm*—Birch, Stewart, Kolasch & Birch, LLP

(57) ABSTRACT

A plasma display panel having a plurality of bi-discharge sources comprising a front substrate and a rear substrate coupled in parallel; a plurality of first electrodes, second electrodes and third electrodes in parallel disposed over the front substrate along a first direction; a plurality of rear substrate walls disposed in parallel over the rear substrate along a second direction orthogonal to the first direction. Each of the plurality of second electrodes is centered between each of the plurality of first and third electrodes, which leads to a bi-discharge source. In each of the plurality of second electrodes, one side is induced as having a plurality of positive charges and the other side with a plurality of negative charges, which are equal amount and thus result in charge counterbalance on the second electrode.

14 Claims, 6 Drawing Sheets

PLASMA DISPLAY PANEL HAVING A PLURALITY OF BI-DISCHARGE SOURCES AND RELATED METHOD OF SUSTAINING DISCHARGE WAVEFORM

BACKGROUND OF THE INVENTION

1. Field of Invention

The present invention generally relates to a plasma display panel (PDP) and a related method of sustaining a discharge waveform. More particularly, the present invention relates to a plasma display panel having a plurality of bi-discharge sources and a related method of sustaining discharge waveform.

2. Related Art

Plasma display panel (PDP) is a device that displays dynamic or static images by spurring gas discharge in the interior of the device. According to a number of electrodes, the PDP may be categorized into specific types. The tri-electrode type is currently mostly used, shown in FIG. 1. In construction, the PDP of the tri-electrode type is composed of a front substrate and a rear substrate, which are each disposed with conductive electrodes parallel with each other.

In the PDP, over the front substrate 100 are disposed a sustain electrode (also known as X electrode) 110 and a scan electrode (also known as Y electrode) 120 parallel therewith. The electrodes 110,120 are each fabricated with indium tin oxide (ITO), which is a transparent and conductive material. With an application of a voltage, the electrodes 110,120 can pass through by a visible light generated in the interior of the PDP and are thus called "transparent electrodes". Unfortunately, the transparent electrode exhibits a poor conductivity, thus that a metal electrode is employed and disposed there over is necessary in order to increase conductivity. Therefore, the metal electrode is generally named "auxiliary electrode" 130. A dielectric layer 140 is covered over the X and Y electrodes 110,120 as an insulate layer, and a magnesium oxide (MgO) layer is covered on the insulating dielectric layer 140 as a passive layer 150.

In the PDP having auxiliary electrodes 130, on the rear substrate 160 is disposed an address electrode (also termed "An electrode") 170 parallel with the X electrode 110 and the Y electrode 120. Similarly, the A electrode 170 is formed as an array corresponding to the X and Y electrode structure. The space defined by the pair of X electrodes 110 and Y electrodes 120, and the A electrode 170, is called a discharge cell (not shown). On the basis of this electrode arrangement, a three dimensional device of the space defined is formed for discharge and light generation. A barrier rib 180 is disposed over the rear substrate 160 between two adjacent A electrodes 170 and used to separate discharge cells corresponding to different colors of the light generated, in order to avoid interruption of emission of the generated light due to cross-walk of a plasma in the discharge cells. On each an electrode 170 and a side of the barrier rib 180 which faces the adjacent barrier rib 180 are sequentially coated with red, blue or green phosphor 190. A pixel is formed by three adjacent discharge cells with different colors. Finally, an inert gas mixture (not shown) is utilized for gas discharge to generate the plasma. The gas is filled between the front substrate 100 and the rear substrate 160. In a high pressure environment in the PDP, the inert gas mixture is de-ionized and discharged with the presence of the electrode structure with external voltages, applied, and thus produces positive and negative ions in the plasma. When the positive and negative ions combine, a ultra-violet light is generated. Once the ultra-violet light is absorbed by the phosphor associated with red, blue and green, energy of the ultra-violet light is translated into red, blue and green visible lights, respectively. Through the transparent ITO-made electrode 110,120 and the front substrate 100, the visible light is outwardly emitted and seen by humans.

Referring to FIG. 2, showing an electrode arrangement of a prior PDP. In the figure, a plurality of electrodes is particularly laid as desired, and an X electrode 200, Y electrode 210 and rear substrate wall 220 jointly define a light emitting cell 230. Referring to FIG. 3, illustrating a waveform of sustained discharge voltage and current produced by a prior PDP. In this case, since the discharge currents of all electrodes pass through an external circuit, i.e. a circuit external to the electrode structure and connected therewith, power loss and circuit costs must increase. Further, a voltage drop may arise owing to the current, driven by the voltages provided as above and flowing through the electrode structure and the external circuit, which may in turn have an impact on an operable voltage range of the PDP.

In view of the description above, in the prior PDP mentioned above each pixel is maintained at a level of luminance by virtue of discharge of the auxiliary electrodes. Thus, the electrode arrangement has a limit on the luminous efficiency of the PDP.

SUMMARY OF THE INVENTION

To work out the foregoing problem, the present invention provides a plasma display panel (PDP) having a plurality of bi-charge sources and a method of sustaining a related discharge waveform. In essence, for a pixel, three electrodes for discharging are provided and the three electrodes jointly form a bi-discharge source. The second electrode is flowed with no significant current, the resistance thereof may not have a rigid reduction demand. Consequently, the second electrode may not involve the auxiliary electrode, or may selectively be made up with the auxiliary electrode and the transparent electrode. With this configuration, less area through which a visible light generated passes is subject to blockade by the auxiliary electrodes, and better luminous efficiency is obtained.

The inventive plasma display panel has bi-discharge sources comprising a front substrate and a rear substrate coupled in parallel; a plurality of first electrodes, second electrodes and third electrodes in parallel disposed over the front substrate along a first direction; a plurality of rear substrate walls disposed parallel to the rear substrate along a second direction orthogonal to the first direction. For a pixel, the second electrode is centered between the corresponding first and third electrodes, which leads to double discharge sources with the first electrode formed there over and the third electrode formed there below respectively. In the second electrode, one side is induced as having a plurality of positive charges and the other having a plurality of negative charges, which are equal in amount and lead to charge counterbalance.

In a preferred embodiment, the second electrode comprises two transparent electrodes disposed in parallel and spaced apart with each other, having a gap there between. An auxiliary electrode is disposed over the two mentioned transparent electrodes and corresponding to the gap at an orthogonal intersection formed by the two transparent electrodes and the corresponding rear substrate wall. Thus, in the mentioned gap, a plurality of windows is formed at other than the auxiliary electrode disposes.

BRIEF DESCRIPTION OF THE DRAWINGS

The present invention will become more fully understood from the detailed description given in the illustration below only, and is thus not limitative of the present invention, wherein.

DETAILED DESCRIPTION OF THE INVENTION

Figure 1:
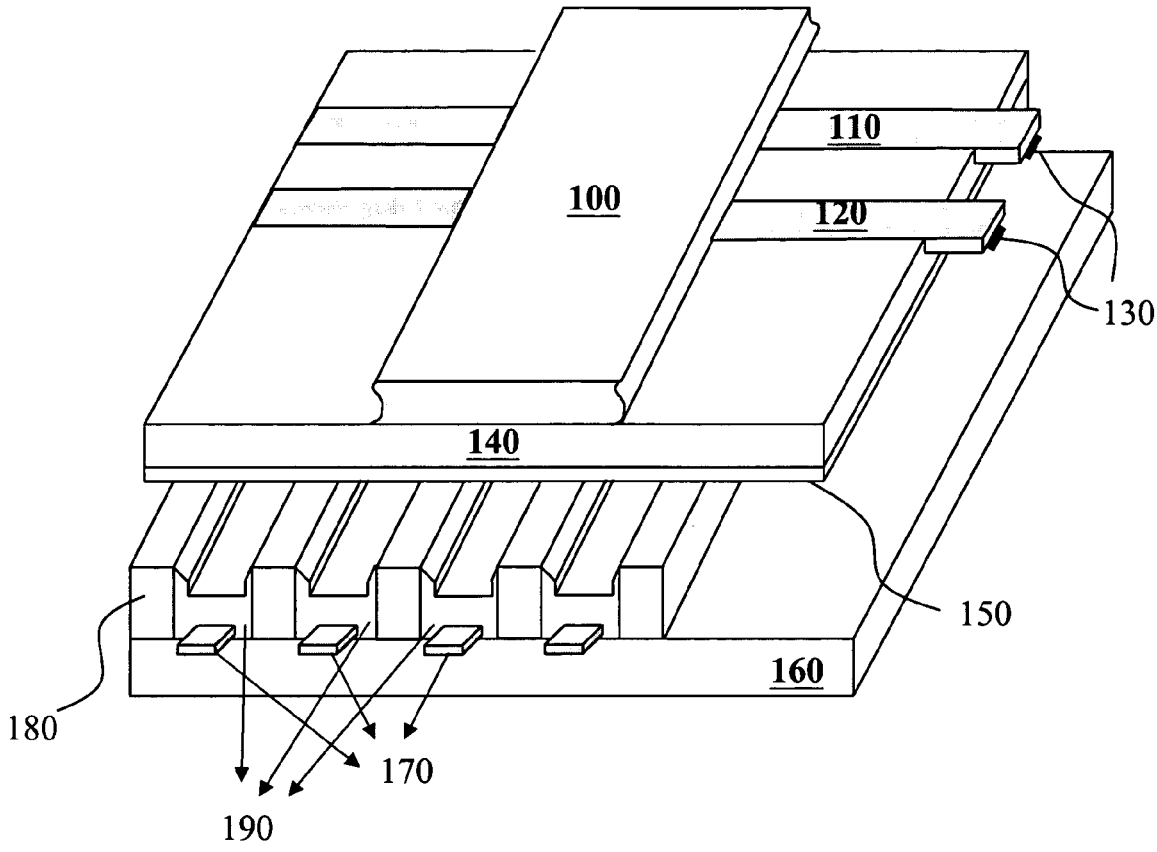
Fig.1 (Prior Art)
FIG. 1 is a structure of the prior plasma display panel (PDP)
Figure 2:
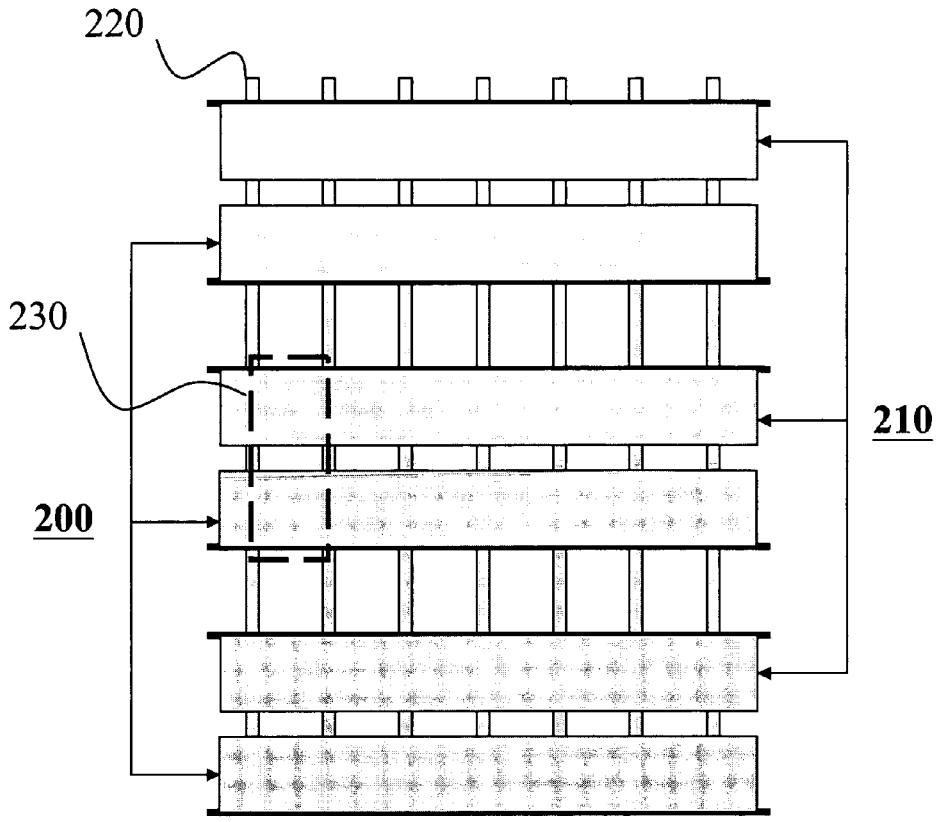
Fig.2 (Prior Art)
FIG. 2 is an electrode structure of the prior PDP.
Figure 3:
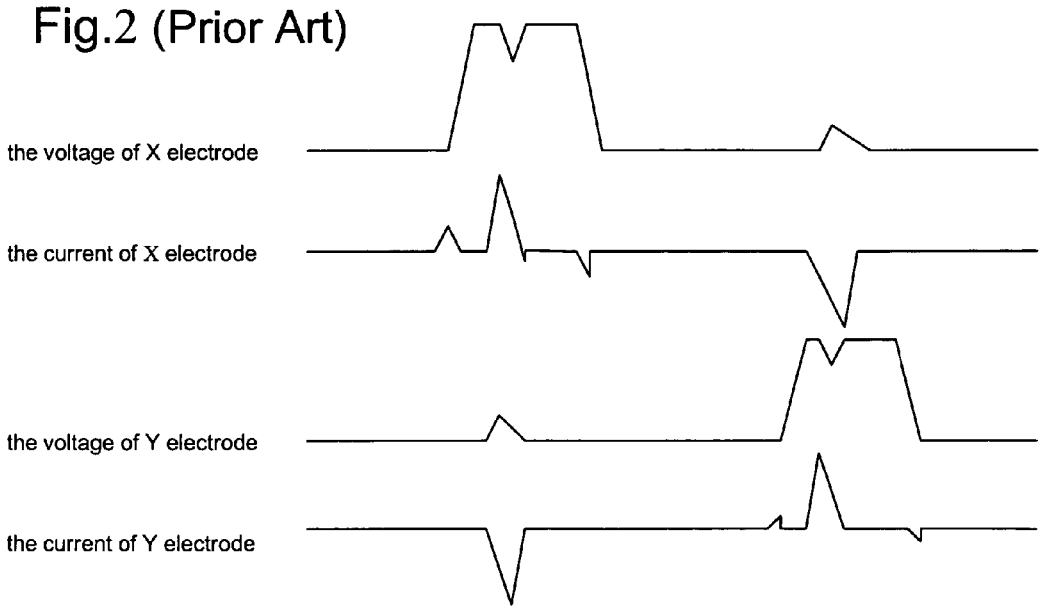
Fig.3 (Prior Art)
FIG. 3 is a waveform of sustained discharge voltage and current in the prior PDP.
Figure 4:
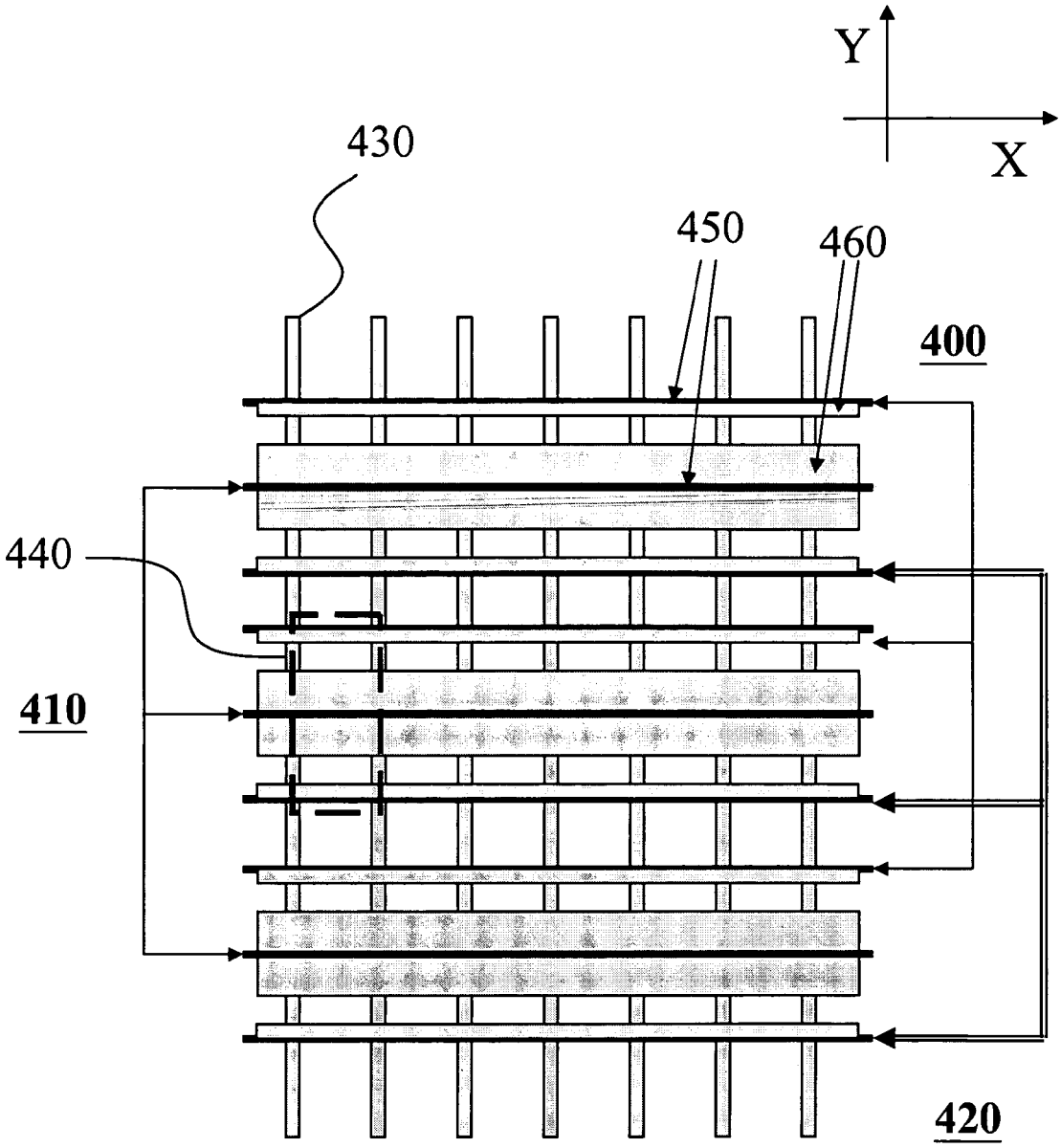
FIG. 4 is an electrode structure of a PDP of the present invention according to a first embodiment in the present invention.

FIG. 4 is an electrode structure of a plasma display panel (PDP) according to a first embodiment in the present invention. In the structure, a plurality of electrode groups is disposed on a front substrate (not shown). Each electrode group comprises a first electrode 400, a second electrode 410 and a third electrode 420 disposed parallel to a first direction (X-axis). A dielectric layer is formed over each of the first 400, second 410 and third 420 electrodes respectively as an insulate layer (not shown). For occurrence of discharge, the first electrode 400, third electrode 420 and a rear substrate wall 430 of the rear substrate (not shown) jointly define a region of a discharge cell 440. The rear substrate walls 430 are arranged parallel to the rear substrate (not shown) along a second direction (Y-axis). In the electrode group, the second electrode 410 functions as an electrode having two discharge sources ("a bi-discharge source" is named hereinafter). Each of the electrodes 400,410,420 comprises a sustain electrode 450 and a transparent electrode 460. The second electrode 410 is disposed centered in the electrode group and mutually discharges with the first electrode 400 disposed there above and the third electrode 420 disposed there below, thus forming two discharge sources.

Figure 5:
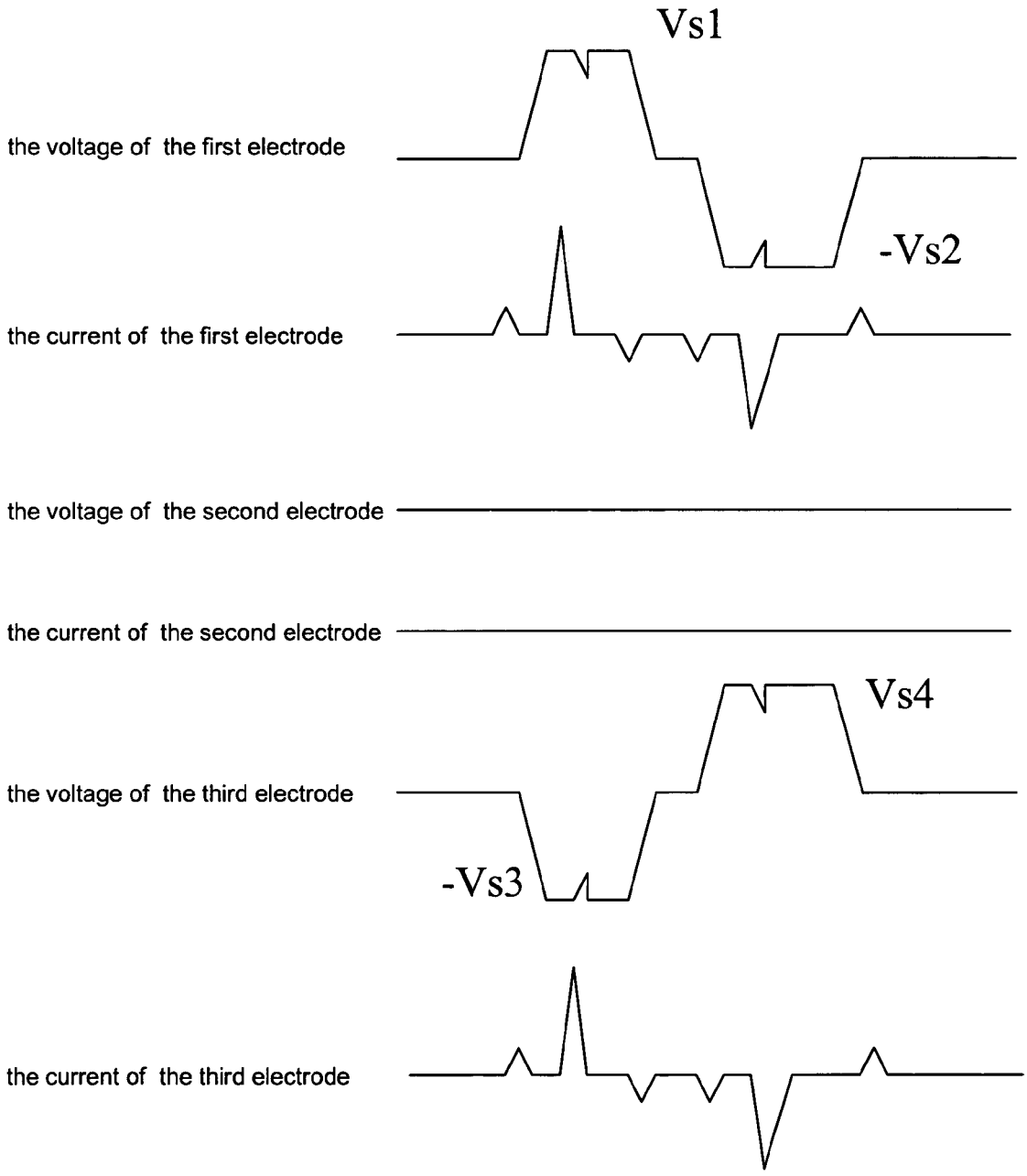
FIG. 5 is a waveform of sustained discharge voltage and current according to the first embodiment in the present invention.
Figure 6:
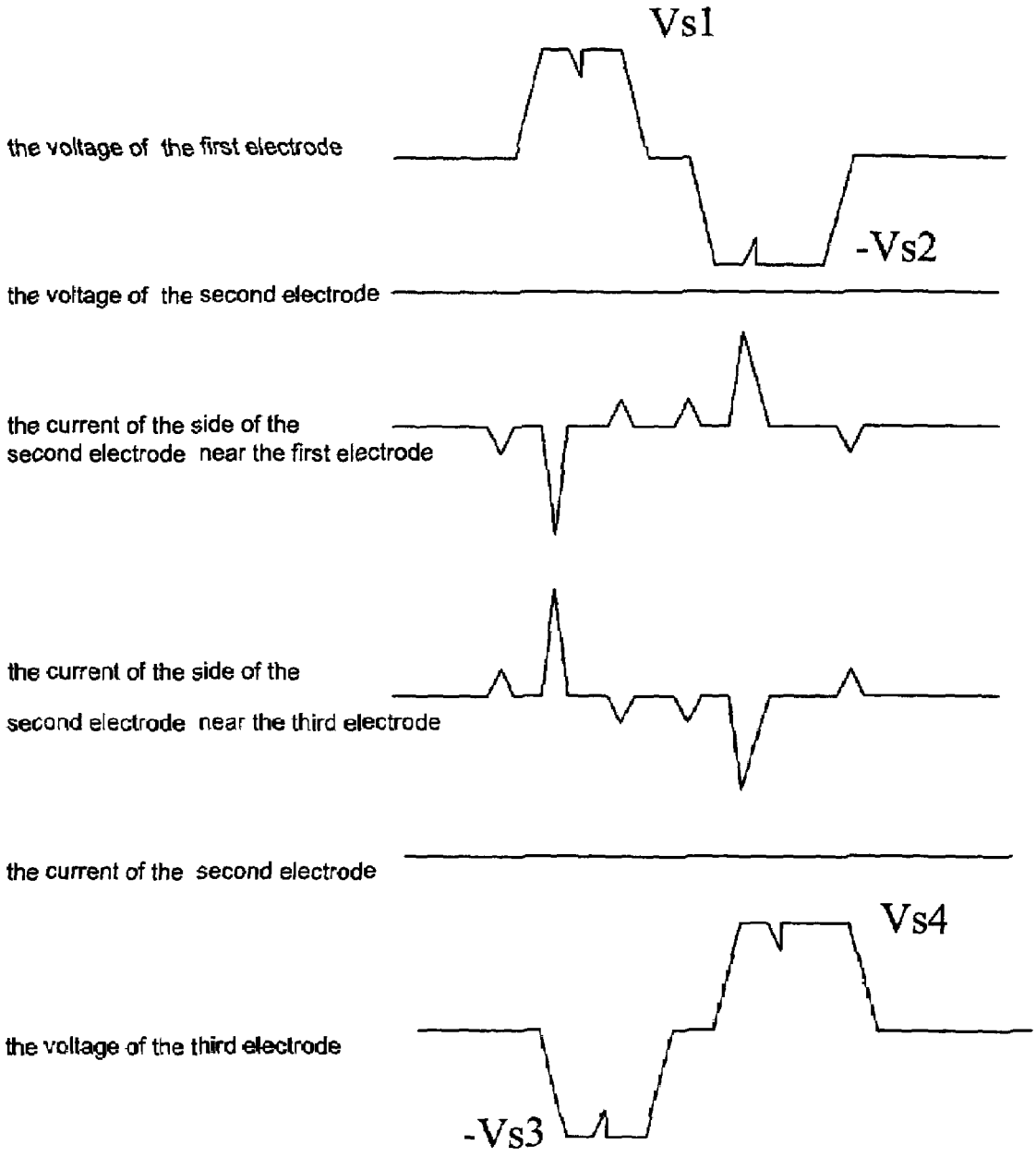
FIG. 6 depicts a counterbalance of a sustained discharge current according to the first embodiment in the present invention.

When the above electrodes are applied with external voltages respectively, the discharging occurs. When the first electrode 400 has a higher potential compared to the second electrode 410, a negative charge of the second electrode 410 moves toward the first electrode 400 and forms a negative wall charge on the dielectric layer over the second electrode 410, hereinafter also called "induction". Similarly, when the second electrode 410 has a lower potential compared to the third electrode 420, a plurality of positive charges of the third electrode 420 moves toward the second electrode 410 and forms a plurality of positive wall charges on the dielectric layer over the second electrode 410. The act of the motion of the positive and negative charges is called "induction". The induction happens on the second electrode 410. Also, the induction is launched on the first and third electrodes 400,420 respectively Referring to FIG. 5, illustrating a waveform of the sustained discharge voltage and current according to a first embodiment of the present invention. As the above, since the currents from the first electrode and the third electrode depicted in FIG. 5 flow toward an external circuit (the provider of the external voltages) coupled with the electrodes through the induction, the second electrode 410 is induced as having positive charges at one side while having negative charges at the other side. In this case, as counterbalance of the induced positive and negative charges occurs, the current from the second electrode 410 is seen as approximately zero from the external circuit's view. In FIG. 5, the assigned labels Vs1, Vs2, Vs3 and Vs4 represent first, second, third and fourth sustained voltages, respectively.

In the same mechanism, when the second electrode 410 has a lower potential than the first electrode 400, the second electrode 410 is higher in potential than the third electrode 420. In this occasion, the second electrode 410 is also seen without current viewed from the external circuit.

Owing to counterbalance of half the total discharge current, the luminous efficiency is double enhanced and thus saves costs for the external circuit. Further, since the approximate zero of the current is seen from the external circuit, a voltage drop may not occur due to the discharge current passing through the second electrode, which sequentially holds a relatively large operable voltage range.

In this case, the current of the side of the second electrode 410 near the first electrode 400 is chargedly neutralized with the other current of the side of the second electrode 410 near the third electrode 420. To compensate for the difference in panel structure and discharge characteristics of each PDP, achieving a minimum (ideally zero) of the net current flowing through the second current 410 may be possible by a waveform control technology by controlling the absolute value of Vs1, Vs2, Vs3 and Vs4. Preferably, the voltages are set to Vs2=Vs3 and Vs1=Vs4 or Vs1=Vs2=Vs3=Vs4.

Figure 7:
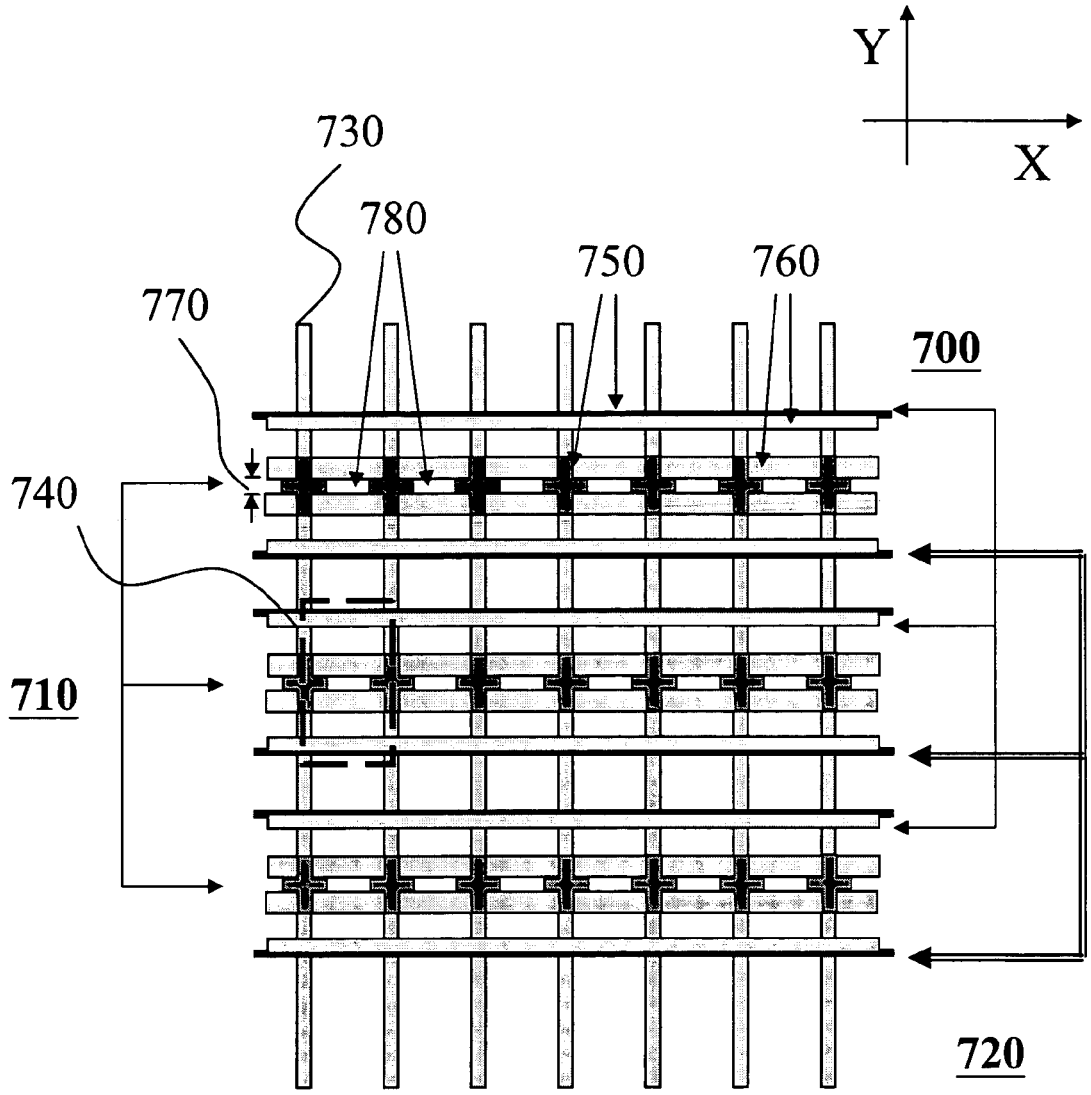
FIG. 7 is an electrode structure of a PDP according to a second embodiment in the present invention.

FIG. 7 is the electrode structure of a PDP according to a second embodiment of the present invention. In the electrode structure a plurality of electrodes is provided over a front substrate (not shown). Each electrode comprises a first electrode 700, a second electrode 710 and a third electrode 720 arranged parallel to the front substrate along a first direction (X-axis). Each of the electrodes 700,710,720 comprises an auxiliary electrode 750 and a transparent electrode 760. A dielectric layer (not shown) as an insulate layer is provided over the electrode 700,710,720. In the electrode structure, the first electrode 700, the third electrode 720 and the rear substrate walls 730 define the region, i.e., the discharge cell mentioned in the foregoing. Each of the rear substrate walls 730 is placed in parallel to the rear substrate (not shown). In operation, since the region between the first electrode 700 and the second electrode 720 and the region between the third electrode 720 and the first electrode 700 each form a discharge, the second electrode 710 is considered functioning as a bi-discharge source.

In all, the present invention is provided with some advantages, which at least include the following. 1. As the efficacy of the PDP is obtained through waveform control technology, approximately half the current does not flow to the external circuit. Accordingly, the luminous efficiency is increased up to almost double and the circuit costs are reduced. 2. Because of fraction of current not flowing to the external circuit, no voltage drop occurs which well enlarges the operable voltage range. 3. Since the second electrode is flowed with no significant current, the resistance thereof may not have a rigid demand of reduction. Consequently, the second electrode may not involve the auxiliary electrode, or may selectively be made up with the auxiliary electrode and the transparent electrode. With this configuration, less area for light emitting outwardly is subject to be blocked by the auxiliary electrode, and better luminous efficiency is reached.

Knowing the invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display panel (PDP) having a plurality of bi-discharge sources, comprising:

a front substrate;

a rear substrate coupled in parallel with said front substrate;

a plurality of first electrodes, second electrodes and third electrodes in parallel disposed over said front substrate along a first direction;

a plurality of barrier ribs in parallel disposed over said plurality rear substrates along a second direction orthogonal to said first direction; and a plurality of light emitting units defined by said first electrodes, said third electrodes and a plurality of said barrier ribs, wherein said second electrodes are centered between said first and third electrodes, each of said second electrodes forms one of said plurality of bi-discharge sources with each of said first and third electrodes respectively, and each of said second electrodes has a side induced as having a plurality of positive charges and the other side induced as having a plurality negative charges and the positive and the negative charges are the same in amount.

2. The PDP of claim 1, wherein each of said first electrodes comprises an auxiliary electrode and a transparent electrode.

3. The PDP of claim 1, wherein each of said second electrodes comprises an auxiliary electrode and a transparent electrode.

4. The PDP of claim 1, wherein each of said second electrodes comprises two transparent electrodes in parallel and spaced apart with each other and having a gap therebetween at an orthogonal intersection of said two transparent electrodes and a plurality of said barrier ribs and a plurality of windows are formed in said gap.

5. The PDP of claim 1, wherein each of third electrodes comprises an auxiliary and a transparent electrode.

6. An electrode structure of a plasma display panel (PDP) having a plurality of bi-discharge sources comprising:

a plurality of first, second and third electrodes disposed in parallel and spaced apart over a front substrate along a direction; and a plurality of barrier ribs supporting said first, second and third electrodes and disposed in parallel and spaced apart along a second direction orthogonal to said first direction, wherein each of second electrodes is centered between one of said first electrode and one of said plurality of third electrode and has a side induced as having a plurality of positive charges and an other side with a plurality of negative charges, and the positive charges and the negative charges are equal in amount.

7. The electrode structure of the PDP of claim 6, wherein each of said first electrodes comprises an auxiliary electrode and a transparent electrode.

8. The electrode structure of the PDP of claim 6, wherein each of said second electrodes comprises an auxiliary electrode and a transparent electrode.

9. The electrode structure of the PDP of claim 6, wherein each of said second electrodes comprises two transparent electrodes in parallel and spaced apart with each other and having a gap therebetween, and an auxiliary electrode disposed over said two transparent electrodes at an orthogonal intersection of said two transparent electrodes.

10. The electrode structure of the PDP of claim 6, wherein each of said third electrodes comprises an auxiliary and a transparent electrode.

11. A method of sustaining a discharge waveform in a plasma display panel (PDP) having a plurality of bi-discharge sources and a plurality of first, second and third electrodes, each of said bi-discharge sources corresponding to each of said first electrodes, each of said second electrodes and each of said third electrodes, comprising:

providing a plurality of first voltages to said first electrodes, each of said first voltages applied to a corresponding first electrode of said first electrodes, and each of said first voltages having a waveform having a feature having a first sustain voltage and a second sustain voltage; and providing a plurality of third voltages to said third electrodes, each of said third voltages applied to one of said third electrodes, and each of said third voltages having a waveform having a feature having a third sustain voltage and a fourth sustain voltage, wherein an absolute value of said first sustain voltage is approximately identical to an absolute value of said fourth sustain voltage and an absolute value of said first sustain voltage is approximately identical to an absolute value of said third sustain voltage.

12. The method of claim 11, wherein each of said first electrodes having a plurality of first positive charges having a first number and each of said three electrodes having a plurality of third negative charges having a third negative charges having a third number and said first number is approximately identical to said third number.

13. The method of claim 12, wherein said first positive charges and said third negative charges moves to each of said plurality of second electrodes.

14. The method of claim 11, wherein absolute values of each of said first, second, third and fourth sustain voltages are approximately identical.

* * * * *